US008998053B2

(12) United States Patent
Cromie et al.

(10) Patent No.: US 8,998,053 B2
(45) Date of Patent: Apr. 7, 2015

(54) LOAD BEARING DEVICES FOR HUMAN LOAD BEARING USAGES

(75) Inventors: John William Cromie, Menlo Park, CA (US); Matthew Stephen Coleman, Los Angeles, CA (US)

(73) Assignee: 5.11, Inc., Modesto, CA (US)

( * ) Notice: Subject to any disclaimer, the term of this patent is extended or adjusted under 35 U.S.C. 154(b) by 408 days.

(21) Appl. No.: 13/115,575

(22) Filed: May 25, 2011

(65) Prior Publication Data

US 2011/0297721 A1 Dec. 8, 2011

Related U.S. Application Data

(60) Provisional application No. 61/350,583, filed on Jun. 2, 2010.

(51) Int. Cl.

| | |
|---|---|
| ***A45C 1/04*** | (2006.01) |
| ***A45F 3/00*** | (2006.01) |
| ***A45F 5/02*** | (2006.01) |

(52) U.S. Cl.
CPC .. *A45F 5/02* (2013.01); *A45F 5/021* (2013.01)

(58) Field of Classification Search
USPC ..... 224/660, 662, 663, 664, 904; 602/19
See application file for complete search history.

(56) References Cited

U.S. PATENT DOCUMENTS

| | | | | |
|---|---|---|---|---|
| 1,655,527 | A | 1/1928 | Williams | |
| 1,940,904 | A * | 12/1933 | Dayton et al. | 602/19 |
| 2,552,475 | A * | 5/1951 | Austlid | 602/19 |
| 2,673,346 | A | 3/1954 | Davis | |
| 2,778,358 | A * | 1/1957 | Keles | 602/16 |
| 3,258,182 | A | 6/1966 | McDonald | |
| 3,526,221 | A * | 9/1970 | Garber | 128/95.1 |
| 3,799,156 | A * | 3/1974 | Gurkin | 602/36 |
| 4,384,372 | A * | 5/1983 | Rector | 2/300 |
| 4,576,154 | A | 3/1986 | Hyman et al. | |
| 4,627,109 | A * | 12/1986 | Carabelli et al. | 2/44 |
| 4,715,364 | A | 12/1987 | Noguchi | |
| 4,750,479 | A * | 6/1988 | Schawl | 602/32 |
| 4,750,652 | A | 6/1988 | Grant | |
| 4,766,891 | A * | 8/1988 | Schultz | 128/882 |
| 5,129,105 | A | 7/1992 | Kleinman | |
| 5,129,647 | A * | 7/1992 | Castellanos | 482/124 |
| 5,201,448 | A * | 4/1993 | Schue | 224/675 |
| 5,228,609 | A | 7/1993 | Gregory | |
| 5,303,860 | A | 4/1994 | Serafini, Jr. | |
| 5,413,262 | A | 5/1995 | Dewire et al. | |

(Continued)

FOREIGN PATENT DOCUMENTS

| | | | |
|---|---|---|---|
| EP | 1 219 393 | A2 | 7/2002 |
| WO | 2004/071231 | A2 | 8/2004 |

(Continued)

*Primary Examiner* — Justin Larson
*Assistant Examiner* — Lester L Vanterpool
(74) *Attorney, Agent, or Firm* — Kilpatrick Townsend & Stockton, LLP

(57) ABSTRACT

A load bearing device for human use include first and second load bearing plates that have a first uncompressed position and a second compressed position that conform to the anatomy of the hips of a human. The plates are sufficiently rigid so as to prevent local inversion when the plates are subject to point or line loads and so as to distribute local loads over the plates. The plates can be used with belts, clothes, backpacks and other load carrying devices and can be incorporated into belts, clothes, backpacks and other load carrying devices.

17 Claims, 9 Drawing Sheets

(56) References Cited

U.S. PATENT DOCUMENTS

| | | | | |
|---|---|---|---|---|
| 5,464,136 | A | 11/1995 | Eddy | |
| 5,765,738 | A | 6/1998 | Hoffner | |
| 5,911,697 | A * | 6/1999 | Biedermann et al. | 602/19 |
| 6,015,073 | A | 1/2000 | Wojciak et al. | |
| 6,015,395 | A * | 1/2000 | Kautzky | 602/19 |
| 6,041,444 | A | 3/2000 | McKinney | |
| 6,066,109 | A * | 5/2000 | Buser et al. | 602/23 |
| 6,088,831 | A | 7/2000 | Jensen et al. | |
| 6,099,490 | A | 8/2000 | Turtzo | |
| D434,544 | S * | 12/2000 | Goldman | D2/627 |
| 6,319,216 | B1 * | 11/2001 | Coligado | 602/19 |
| 6,390,348 | B1 | 5/2002 | Godshaw et al. | |
| 6,398,092 | B1 | 6/2002 | Ansley | |
| 6,547,118 | B2 | 4/2003 | Beletsky et al. | |
| 6,701,534 | B2 | 3/2004 | Guibord | |
| 6,769,586 | B1 | 8/2004 | Beletsky et al. | |
| 6,907,620 | B2 | 6/2005 | Sullivan-West | |
| 7,037,284 | B2 | 5/2006 | Lee | |
| 7,083,584 | B2 * | 8/2006 | Coligado | 602/19 |
| 7,165,706 | B2 | 1/2007 | Barr | |
| 7,329,231 | B2 * | 2/2008 | Frank | 602/19 |
| 7,350,682 | B2 * | 4/2008 | Meyer | 224/628 |
| 7,350,683 | B2 * | 4/2008 | Meyer | 224/628 |
| 7,762,440 | B2 | 7/2010 | Cook | |
| 7,770,770 | B2 | 8/2010 | Murdoch et al. | |
| 7,865,975 | B2 | 1/2011 | Davies et al. | |
| 7,900,278 | B2 * | 3/2011 | Pittman et al. | 2/310 |
| 7,905,849 | B2 | 3/2011 | Park | |
| 8,011,545 | B2 * | 9/2011 | Murdoch et al. | 224/672 |
| D649,648 | S * | 11/2011 | Cavalieri et al. | D24/190 |
| 8,191,550 | B2 * | 6/2012 | Lee et al. | 128/99.1 |
| 2006/0043137 | A1 * | 3/2006 | Carroll | 224/625 |
| 2006/0278676 | A1 | 12/2006 | Lyle | |
| 2007/0006367 | A1 | 1/2007 | Newman et al. | |
| 2007/0135278 | A1 | 6/2007 | Grigoriev et al. | |
| 2007/0251965 | A1 | 11/2007 | Mosley | |
| 2008/0010730 | A1 | 1/2008 | Twito et al. | |
| 2008/0023514 | A1 * | 1/2008 | Hurn et al. | 224/660 |
| 2008/0210729 | A1 * | 9/2008 | Pittman et al. | 224/662 |
| 2008/0223888 | A1 | 9/2008 | Meunier | |
| 2008/0289623 | A1 * | 11/2008 | Lee | 128/96.1 |
| 2010/0088799 | A1 | 4/2010 | Carter | |
| 2011/0132951 | A1 | 6/2011 | Vennemeyer | |

FOREIGN PATENT DOCUMENTS

| | | | |
|---|---|---|---|
| WO | 2010/042222 | A2 | 4/2010 |
| WO | 2011/156317 | A1 | 12/2011 |

* cited by examiner

Uncompressed Condition
Top View

1

Compressed Condition
Top View

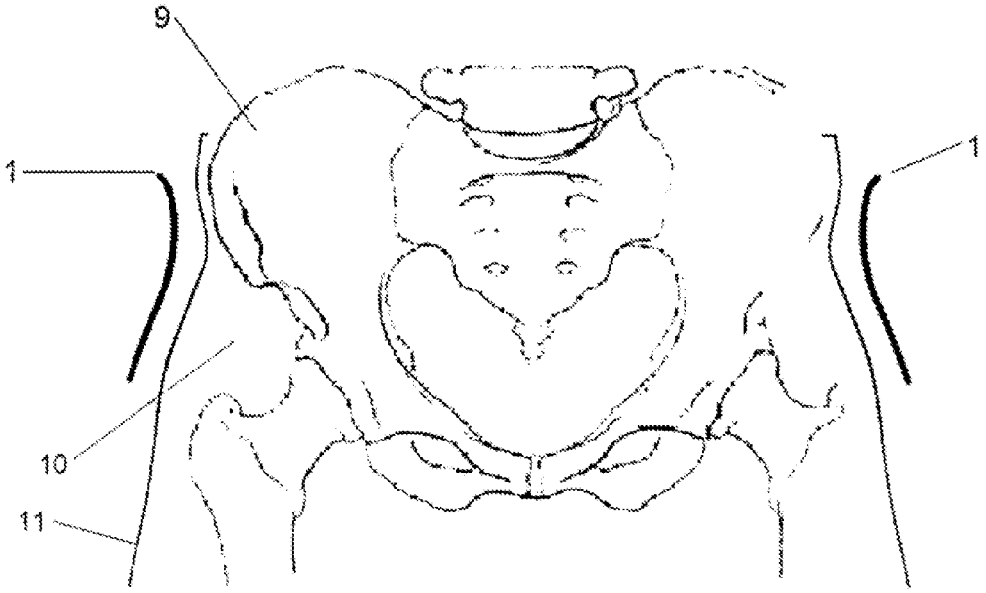
FIG 4a: Cross Section of Preferred Embodiment for Males with Anterior View of Male Pelvis and Skin Outline
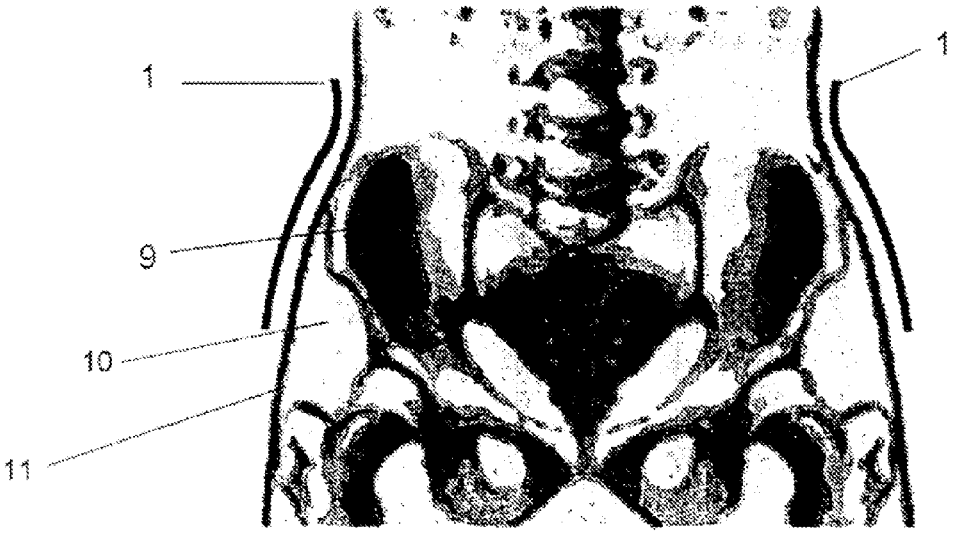
FIG 4b: Cross Section of Preferred Embodiment for Females with Anterior View of Female Pelvis and Skin Outline

LOAD BEARING DEVICES FOR HUMAN LOAD BEARING USAGES

CLAIM OF PRIORITY

This application claims benefit to U.S. Provisional Application No. 61/350,583, filed Jun. 2, 2010 entitled "LOAD BEARING DEVICES FOR HUMAN LOAD BEARING USAGES".

FIELD OF INVENTION

The subject invention relates to health equipment, tactical and recreational gear, and relates more specifically to the correct load bearing on human hips.

BACKGROUND

Since the invention of tools, men have had to carry them from place to place. The belt was identified early as an optimal place to carry items both for the hip's inherent load bearing ability as well as the quick access provided for weapons and tools. Today, a broad range of professionals still carry their equipment on their hips on a daily basis: police officers, construction workers, and soldiers to name a few. In both recreation and military load bearing, heavy backpacks typically offload significant amounts of weight to the hips in an effort to by-pass the spine.

As tools have become more capable, those who carry them have been required to carry more and more around their waist. However, there has been little advancement in the devices which actually hold the equipment to the user's waist. To this day, police officers wear a simple "Sam Browne" belt which, while heavily reinforced to carry the load, has little to no ergonomic shaping of any kind. As a result of this increased loading, those who bear it have found themselves compensating their posture to alleviate discomfort leading to chronic pain, nerve damage, circulation loss and spinal injury, as well as an increased risk for injury brought on by sudden movements.

Due to the body's natural "shelf" profile at the top of the gluteus muscle group, which is more pronounced at the spine and gradually reduces around the front and eventually disappearing at the front of the iliac crest, as a user loosened his/her loaded belt, it would begin to slip from that natural shelf starting at the iliac crest and moving backwards until the load was supported largely by the gluteus maximus muscle group and lumbar vertebrae. Under these conditions, the belt would begin to drop in the front and continue until it was tilted forward at a significant angle (sometimes as much as 20 deg from horizontal). In this condition, the belt exerts forward pressure on the lumber region of the spine, and causing a forward pitching moment around the pelvis. The user was then faced with the unfortunate choice of a belt continuing to roll the pelvis forward, eventually leading to "swayback," a condition associated with forward rotated hips, or tightening the load belt further and further to keep it on the lateral muscle shelf under the iliac crest. Furthermore, it is known that pressure acting perpendicular to a muscles line of action inhibits the muscle's proper actuation. This is used in injury recovery to protect injured muscles from reinjuring themselves. In the case of belted load bearing, the belt puts pressure across the wearer's lumber area and abdominal column, heavily restricting the proper use of those muscles. This inhibits the muscles most critical in standing or sitting with correct posture, leaving the user more vulnerable to a slouched, hip-forward posture, amplifying the risk of swayback.

Additionally, many of the components designed to carry individual components on a belt, as seen in a law enforcement officer's duty gear, have been designed with stiffness and rigidity in mind. But as the belt on which the components are strung is not rigid, each component has some limited range of motion over which it can move independently of the other components. As a result, by moving through different postures and positions, the wearer can be pinched, jabbed or otherwise hurt by these components. As many of these components have relatively sharp edges, they tend to dig in to the wearer causing loss of circulation, or rub causing calluses and bruising.

Prior art sought to solve the issue of an incorrectly loaded pelvis by unloading the pelvis entirely and loading the spine. Initially, this was accomplished using suspenders to move the load to the shoulders. While effective in alleviating the burden from the hips, suspenders have several disadvantages. First, in the case of law enforcement officers, the suspenders become a grab point which an adversary could get a hold of, to the detriment of the officer. Recent updates to the suspenders have enabled them to be worn under the user's clothes to prevent the tactical risk of exposed straps (Blackhawk & Back Defender). Second, suspenders load the shoulders and thus the spine, which defeats the purpose of taking advantage of the hip's natural load bearing ability. Third, prolonged activity in which the arms are raised, greatly increases fatigue as the shoulders must carry not only the arm and the tool in use, but the weight of the suspended load as well. Finally, during intense physical activity such as running, the weighted belt will tend to bounce up and down against the suspenders in response to the user's natural running motion, as the suspenders only restrict the belt from moving down past their own length, but do not secure the belt in a fixed location.

Another example of prior art sought to combat the lumbar pressure by inserting a large pad underneath the belt in the small of the user's back. This was to distribute the load over a larger area on the officer's back. While effective at its intended goal of local weight distribution, this prior art also had several deficiencies which prevented it from seeing widespread adoption. First, the excessively large pad interfered with vest-type body armor. Second, the device reduces pressure, but fails to fundamentally alter the load paths from the burden to the body, and so fails to eliminate the sway-back condition, or any of the pressure points on the lateral or anterior areas of the hips. Finally, a thick compliant pad makes an unstable platform for the equipment being worn, further decoupling the load from the wearer's body. This makes physical activity more awkward, and accessing the tools worn, for example, drawing a firearm, more uncertain as the holster or equipment container is not rigidly fixed to anything during the draw.

Another example of weight distribution on the hips is that of the padded belt. This is nearly universal in heavy backpacking, but has seen effectively no adoption in law enforcement due to the increased bulk, and the reduced stability of the objects carried. This prior art seeks to distribute point loads through thick padding, and does nothing to alter the load paths away from the spine and correctly to the lateral areas of the pelvis.

In light of the burden born by so many, and the inadequacy of the prior solutions, there is a need for a device which can correctly shape the load paths caused by a weighted belt worn around a user's waist, effectively distribute pressure points, relieve pressure from the spinal and abdominal muscle groups, provide a stable platform during strenuous physical activity or tool/weapon draw, and effectively link individual components of a multi-element load so they behave kinematically as a single mass.

SUMMARY OF THE INVENTION

The embodiments of the disclosed invention addresses chronic discomfort and injury suffered by persons who carry equipment, gear or weight around their waist, typically on a belt, as seen in law enforcement officers, soldiers and backpackers.

The embodiments of the disclosed invention solves these problems with embodiments of the invention which include thin, spring-like and semi-rigid plates which preferably approximates the contours of the body in the region of the lateral sides of the pelvis, which have the properties of being stiff enough to distribute point or line loads over a broad area, significantly increasing user comfort and eliminating the need for the user to adjust his/her posture to compensate for pressure points, or other discomforts associated with the load. Still alternatively, embodiments of the invention include spring-like curved plates that do not conform to the body in vertical cross-section and include padding adjacent of the body to conform to the body for comfort.

Furthermore, in embodiments of the invention, the curvature in the horizontal plane is naturally slightly larger than the wearer's waist, such that when compressed against the body as under a belt, the plate exerts a spring force against the belt away from the body along the length of the plate moving away from the centerline. This unloads the abdominal and spinal areas and applies lateral loads to the sides of the pelvis and the gluteus muscle group, effectively coupling the load to the wearer's pelvis. Correcting the load location frees the wearer from needing to compensate for an incorrectly placed load, typically done by standing in an ergonomically incorrect position. The corrected load is positioned to take the most direct path through the pelvis to the femur and down to the ground. In other embodiments, the spring action of the device has the further quality of applying a larger securing force to the lateral area of the pelvis due to the mechanical reaction force, without extra tightening of the belt thus avoiding the typical result of cutting off circulation and impinging on nerves.

Embodiments of this invention solve the problem of discontinuity between load elements by being substantially stiff across the entire device, minimizing or eliminating relative motion between the load elements. As the user moves, the independent elements are subjected to different loads, and their relative position is determined only by the belt to which they are attached. Belts universal in this type of application are insufficiently stiff to maintain a consistent relative position of the load elements, and so when subjected to different loading conditions, the elements are free to an extent to move relative to one another, kinematically behaving as a series of loosely coupled masses. This can cause the elements to pinch or jab the wearer and be a contributing factor in injury and discomfort. By holding each load element securely against the device, the individual load elements are fixed relative to one another and can no longer move independently. This has the property of making a multi-element load behave kinematically as a single element load on each hip, whose relative geometry is restricted to the flexibility of the device. More beneficial to user comfort is that the shape to which the elements are constrained is very close to the geometry of the user's hips as described in herein. Furthermore, embodiments of the invention are sufficiently stiff that a reasonably expected point load from a single element will not disrupt the continuity of the main curvature by causing it to locally invert and become convex instead of concave. While the numerical value of the local radius of curvature is not necessarily uniform across the device, it should not grow to infinity, geometrically defined as a flat spot in the curve, or invert as this may cause a local pressure point on the user.

BRIEF DESCRIPTION OF THE FIGURES

FIGS. 4*a* and 4*b* show anterior views of the skeletal structure of the male and female pelvis (9), respectively, and surface of the skin (11), and a cross-section profile of the embodiment of the invention (1) in the preferred embodiment for both males and females, respectively.

DETAILED DESCRIPTION OF THE PREFERRED EMBODIMENTS

Preferred embodiments of the invention are set out below. It is to be understood that the embodiments of the invention can be provided separately and then used in conjunction with belts, clothes, backpacks or other load bearing devices suitable for a human to use to carry a load. Further other embodiments of the invention can be incorporated and designed into belts, clothes, backpacks and other load bearing devices suitable for a human to use to carry a load.

It is to be understood that although the below embodiment is depicted as including first and second plates, that another embodiment of the invention can have the first and second plates combined into a single plate and be within the spirit and scope of the invention. By way of example only, an embodiment of the single plate design has a connector that maps to the back side of the user and connects the first plate to the second plate. The connector is flexible and adjustable so that the position of the first plate relates to the second plate and can be adjusted depending on, for example, the waist size of the human using this embodiment of the invention. Another example of an embodiment could include the two main load plates integrated into the user's clothing.

It is to be understood that although the below embodiment is depicted as a cross-section that is revolved around an axis with a constant radius of curvature and sufficiently flexible to conform to the user's pelvic and hip geometry, that another embodiment of the invention can have a shape that has multiple different local cross-sections which provide a more exact approximation of the wearer's hips and which are not related to one another by a constant inner radius. By way of example only, an embodiment of the design may be custom mapped to a specific user.

Figure 1:
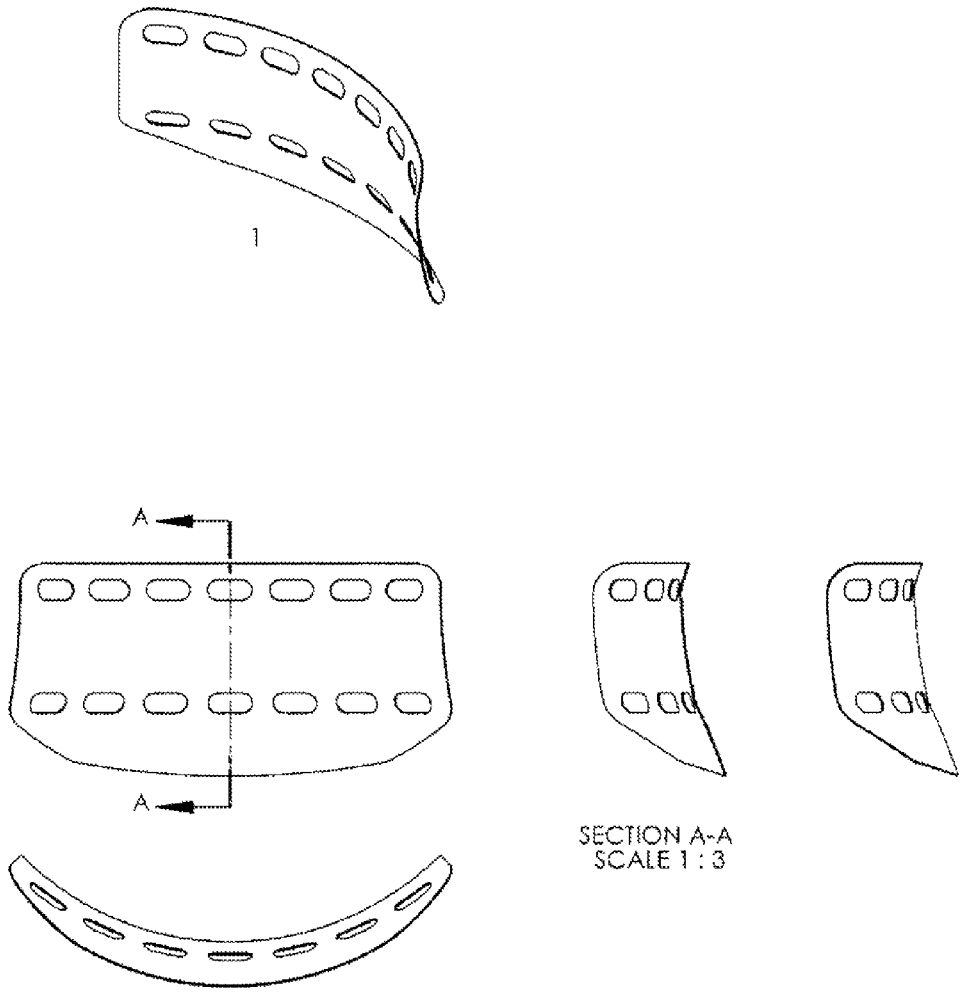
FIG. 1 is a 3-view of the preferred embodiment of the invention including a cross-section and isometric view.
Figure 2:
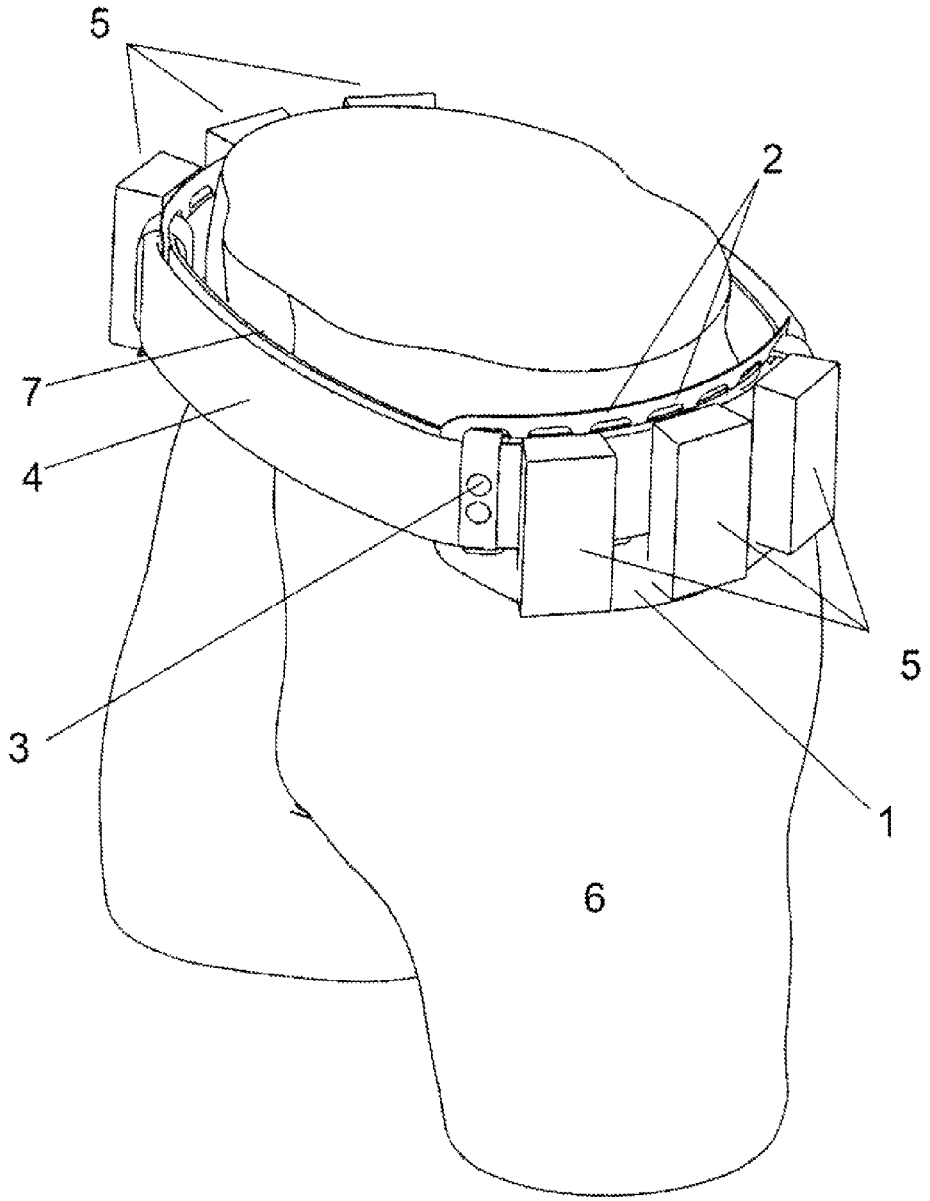
FIG. 2 is an isometric view of the preferred embodiment of the invention in relation to an arbitrarily loaded belt with independent masses, shown on the relevant portion of a human figure. The load distribution devices or elements (1) of embodiments of the invention are positioned between the user's (6) pants belt (#) and load bearing belt (4) opposite one another on the lateral portions of the user's (6) hips. A set of keepers (3) are looped around both belts and through the slots (2) of the embodiment of the invention.
Figure 3A:
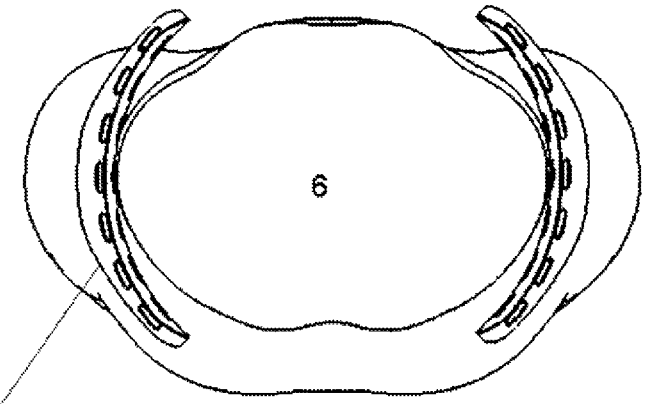
FIG. 3*a* shows a top view of the preferred embodiment of the invention (1) in the unloaded position (uncompressed condition) relative to a sectional representation of a human FIG. 6).
Figure 3B:
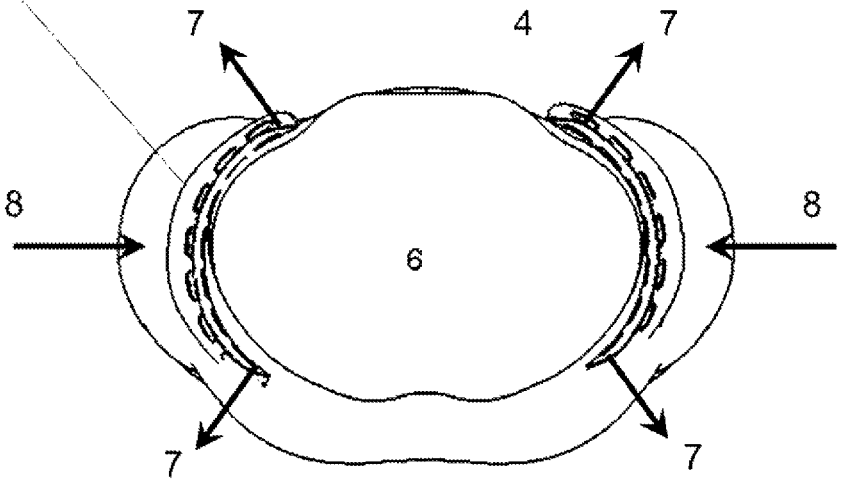
FIG. 3*b* shows a top view of the preferred embodiment of the invention (1) in the loaded position (compressed condition), constrained under an example belt (4) relative to a sectional representation of a human FIG. 6). This figure shows resultant forces (7), (8) from the deflection of the device.
Figures 5A, 5B:
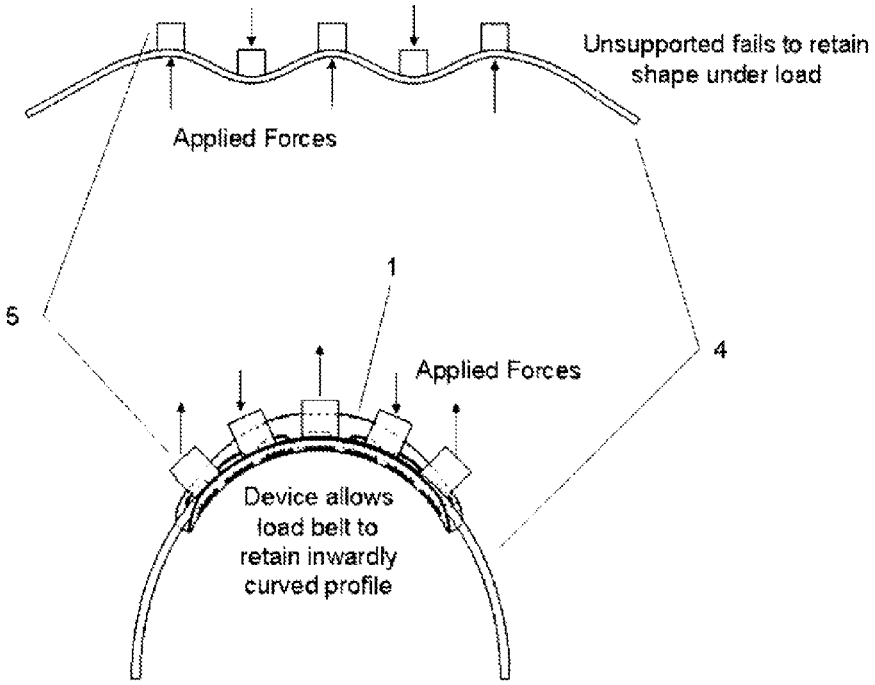
FIG. 5*a* shows the top view of the resultant deflection of a typical "Sam Browne" duty belt with opposite forces applied to each load component. This demonstrates the independent motion possible by the individual load elements because they have a loose kinematic coupling of only the belt. The resulting concave, convex inversions of the belt are shown.
FIG. 5*b* shows the top view of the same load case while constrained to an embodiment of the invention (1) as worn by a user. In this load case, when the belt is coupled to the embodiments of the invention, these embodiments maintain their main radius of curvature as concave and do not locally invert, i.e. become convex, at any point, even though the radius of curvature may change by small amounts.
Figure 6A:
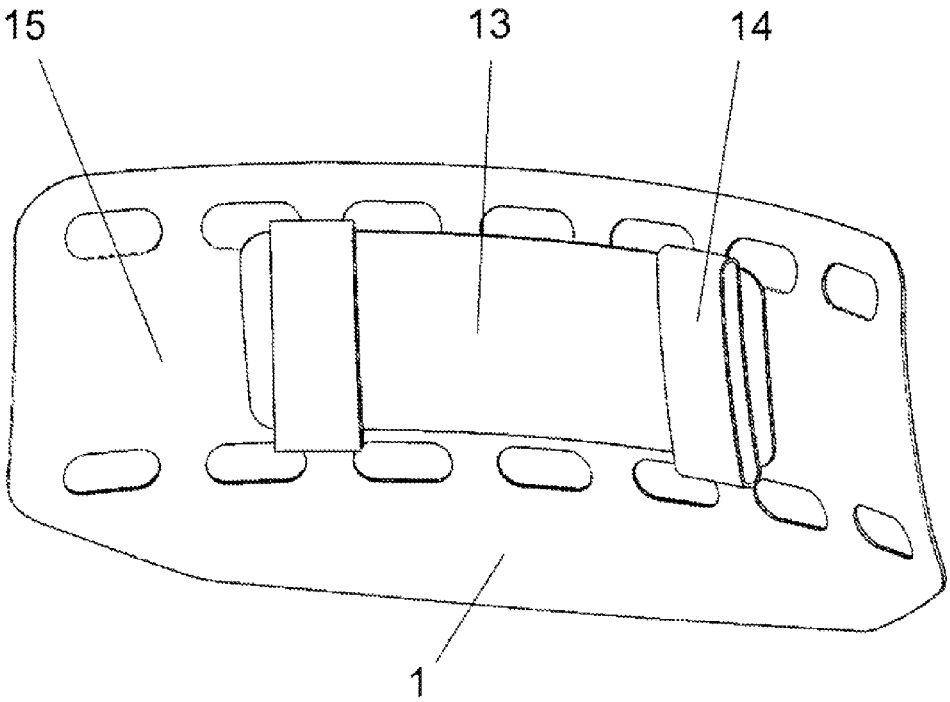
FIG. 6*a* shows an inside view of a primary plate (1) with hook & loop (Velcro™) backing (15) attached to a secondary plate (13) with substantially similar curvature and the mating side of the hook & loop with straps (14) to attached the secondary plate to a belt.
Figure 6B:
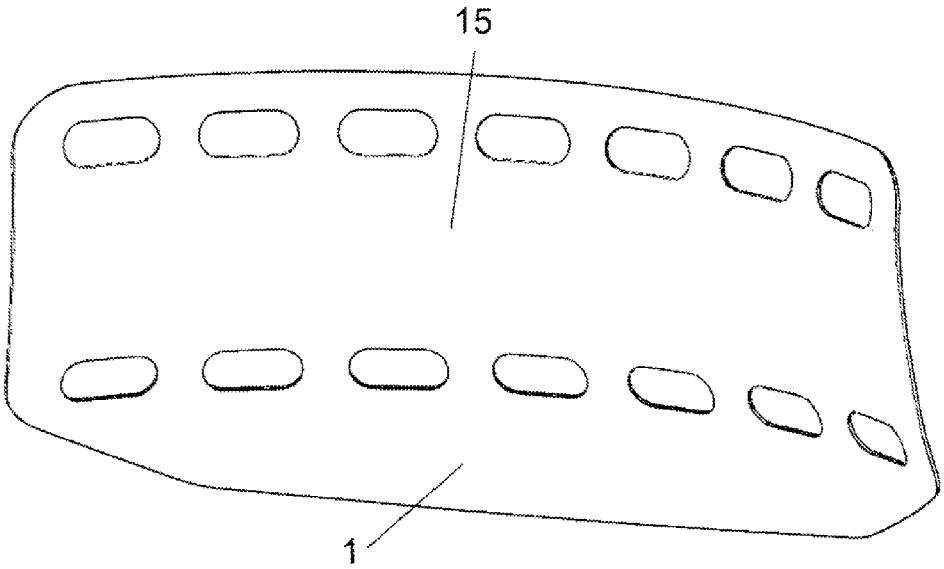
FIG. 6*b* shows an inside view of a primary plate (1) with hook & loop (Velcro™) backing (15).
Figure 6C:
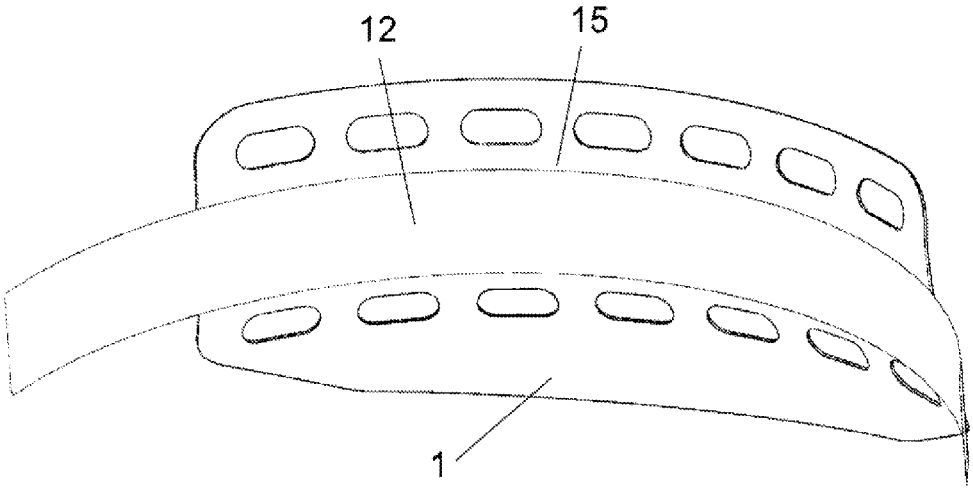
FIG. 6*c* shows an inside view of a primary plate (1) with hook & loop (Velcro™) backing (15) mated to an inner belt (12) which has embedded hook & loop.
Figure 6D:
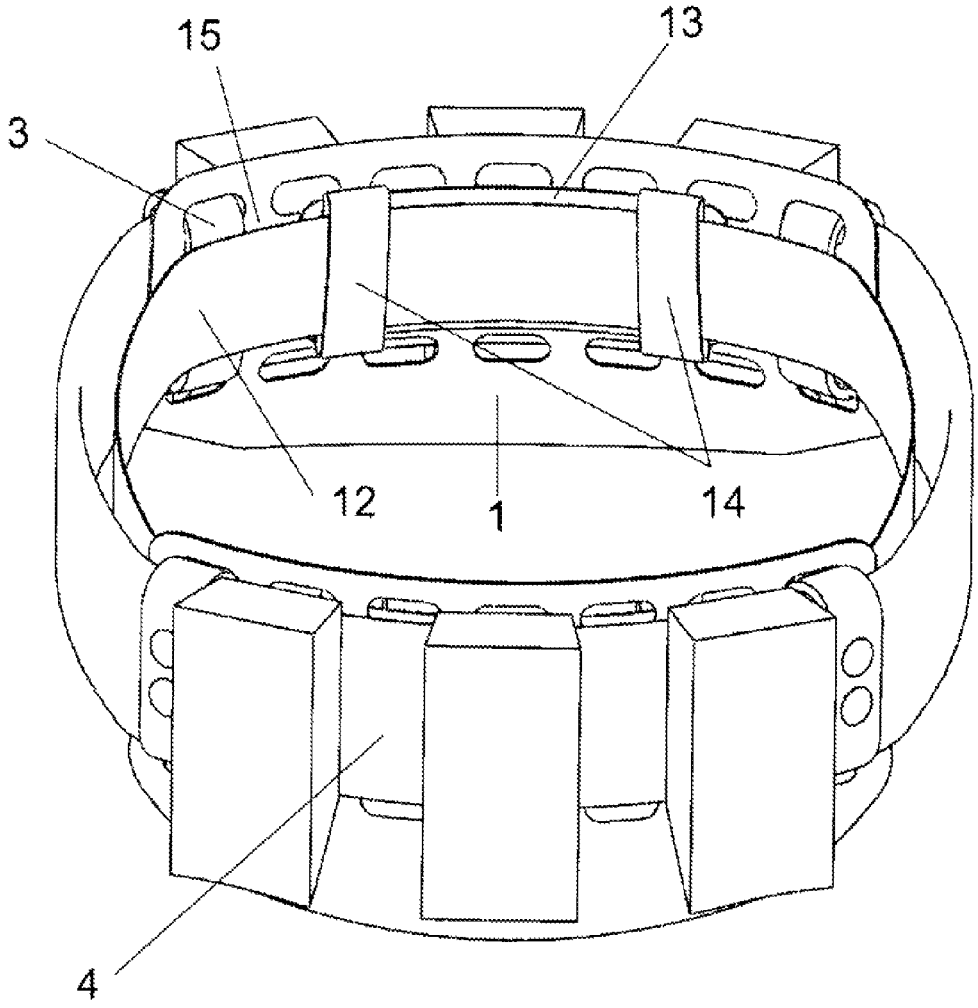
FIG. 6*d* shows a preferred embodiment of the invention (1) connected with keepers (3) to a load bearing belt (4). The device (1) is attached to a secondary plate (13) with hook & loop (15) over the mating surface. The inner belt (12) is threaded through the loops (14) of the secondary plate (13), thus forming a secure connection from the load belt (4), through the primary plate (1) and secondary plate (13) to the inner belt (12).
Figure 7:
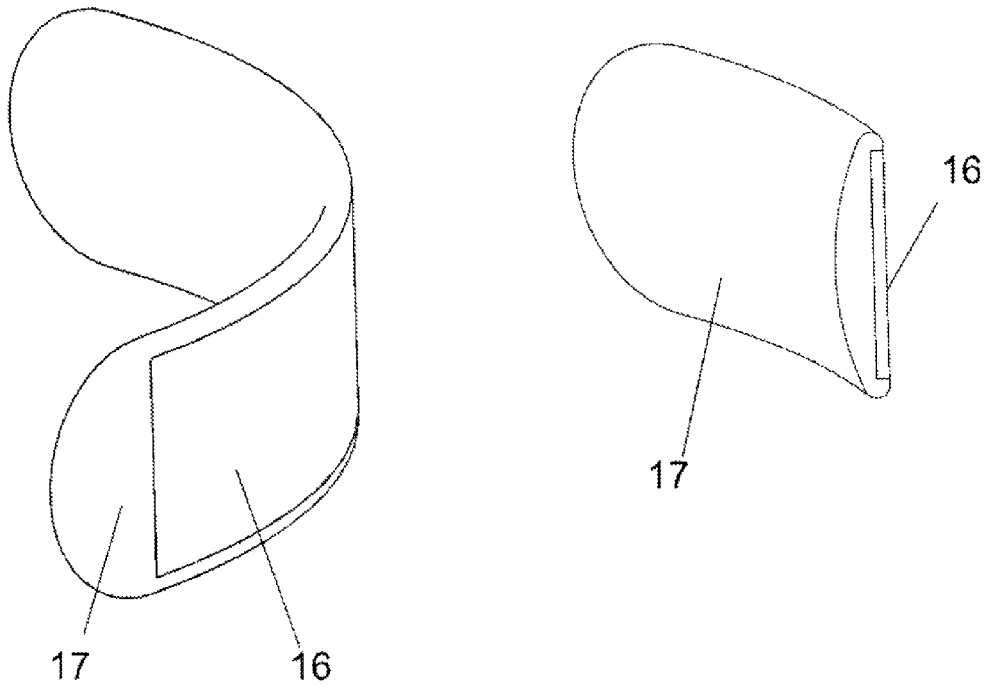
FIG. 7 shows the primary plate (16) embedded in a flexible pad (17) and a cross section of the same.

A preferred embodiment of the invention includes a pair of semi-rigid and plate/spring load distribution devices (1) worn roughly opposite one another on a user's (6) hips, as shown in FIG. 2, having a cross-sectional curvature which approximates the sectional view of the human hips (11), either male as shown in FIG. 4*a*, or female as shown in FIG. 4*b*, relative to the Pelvis (9), Femur and Gluteus muscle groups (10), having a major curvature approximating the horizontal cross-section of the human pelvic region (6) as shown in FIG. 3*a*, having a major curvature which can be of a larger radius than local geometry of the horizontal cross-section of the human hips (6) as shown in FIG. 3*b*, having a material which, when compressed in the manner shown in FIG. 3*b*, reacts with resultant forces (7) and (8), and is substantially stiff enough to prevent local discontinuities in any of the plate curvature when subjected to point or line loads as shown in FIG. 5*b*, and is substantially stiff enough to distribute local loads over a broad area, having a series of slots (2), spaced between 2 and 2.5 inches vertically as seen in FIG. 1 which allow the normal use of keepers (3) which can be used to attached the device to the load belt (4) as shown in FIG. 2 and/or to an inner belt.

Other embodiments of this device contain the geometry as an integral part of a belt or strap system as part of a backpack, harness or equipment belt, or sewn in as an integral part of the user's clothing.

Other embodiments of this device include provisions to attach to the user's duty belt in such a way that the device remains attached to the user's duty belt when the user removes the duty belt. Such an embodiment may contain provision for temporary, quickly released attachment to the user's inner belt.

Other embodiments of this device include provisions to attach to the user's inner belt in such a way that the device remains attached to the user's inner belt when the user removes the duty belt. Such an embodiment may contain provision for temporary, quickly released attachment to the user's duty belt.

Suitable materials that can be used for embodiments of the invention are plastic and polymers that can be molded, are flexible and can support weight. Such polymers can include, by way of example only, polyetheretherketone (PEEK), polyetherketoneketone (PEKK), polyetherketone (PEK), polyetherketoneetherketoneketone (PEKEKK), and polyetheretherketoneketone (PEEKK). Still, more specifically, the material can be PEEK 450G, which is an unfilled PEEK available from Victrex of Lancashire, Great Britain. (Victrex is located at www.matweb.com or see Boedeker www.boedeker.com). Other sources of this material include Gharda located in Panoli, India (www.ghardapolymers.com) or another biocompatible polymer.

Additional polymers include can include engineering plastics that have been blended with fibers such as carbon, glass, Kevlar or aramid fibers for strength. These additional plastics include, by way of example only, Nylon, Acrylonitrile butadiene styrene (ABS), or Polycarbonate. Thermoset resins traditionally used with fiber weave reinforcements are also example materials. Also, the thickness of the plates which affords the ability of the plates to withstand local inversion when subject to loads is about 0.080 in and is in the range of about 0.030 in to about 0.125 in depending on the stiffness of the material used. Two example measures of the stiffness of the material are the material's tensile (or elastic) modulus and its flexural modulus. An example measure of the stiffness of the plate would be the reaction force created when compressing the main radius of curvature.

Metals with high spring rates, such as steel or Titanium alloys are suitable materials. By way of example only, spring steel or high carbon steel can be used.

The method of anchoring an object to a person having hips, a waist, abdominal muscles, and lower back muscles, the method comprising the steps of wrapping a belt around said person's waist, tightening said belt around the wait of said person, exerting pressure inwards toward the body and distributing said pressure against the hips of said person, exerting pressure outwards against one or more surfaces along the interior surface of the belt to push the belt away from the abdominal muscles and the lower back muscles, and attaching said object to said belt.

The method of paragraph 37 wherein the step of exerting pressure includes exerting pressure against the hips that is equal on both the left and right sides.

The method of paragraph 37 wherein the forces in the step of exerting pressure against the hips of said person are generated by a device or plurality of devices.

The method of paragraph 39 wherein two instances of said device are used in tandem to exert pressure on opposite hips.

The method of paragraph 40 where in one instance of said device has a left configuration and a second instance has a right configuration.

The method of paragraph 39 wherein a single instance of said device exerts pressure on both the left and the right hip simultaneously.

The method of paragraph 39 wherein the step of exerting pressure includes pressure against the hips and the pressure against the surface or surfaces of the belt which is generated by a spring.

The instance of paragraph 39 wherein the step of exerting pressure includes pressure against the hips and the force against the surface or surfaces of the belt which is generated by a lever.

The instance of paragraph 39 wherein further objects are attached to that said object, which is attached to said belt.

The instance of paragraph 42 where said object is attached to said device instead of directly to said belt.

The instance of paragraph 41 wherein the means of attaching the object to the belt is by a snap.

The instance of paragraph 37 wherein the means of attaching the object to the belt is by Velcro™.

The instance of paragraph 37 wherein the means of attaching the object to the belt is by static pressure between the belt and the object.

The instance of paragraph 37 wherein the belt is a component of a backpack.

The instance of paragraph 37 wherein the belt is a component of a garment.

The method of redistributing pressure against the body of a person resulting from wearing a belt with an attached load, the person having a waist, two hips, abdominal muscles, and lower back muscles, the method comprising: exerting pressure against the interior wall of the belt at least four areas including the front left, front right, rear right, and rear left extremes of the circumference of the belt so as to push the belt away from the body along the abdominal muscles and lower back muscles, and distributing said pressure laterally against the sides of the pelvis such that said pressure is exerted against pelvis perpendicularly to the left and right sides of the pelvis.

The method of paragraph 52 wherein the step of redistribution is performed by a mechanical force.

The method of paragraph 53 wherein said mechanical force is a spring action.

The method of paragraph 53 wherein said mechanical force is induced by a lever or series of levers.

The method of paragraph 53 wherein said mechanical force is generated by the propensity of a flexible or semi-rigid material to return to its unflexed state when flexed.

The method of enabling free rotation of a belt along an roughly axis extending from the left hip socket to the right hip socket of the person wearing said belt, the method comprising: mechanically coupling the belt against two points along said access through lateral pressure against the Gluteus muscle groups on both the left and right sides of the pelvis at each end of said axis, and pushing the belt away from the body along the front and rear length of the belt.

The method of paragraph 57 wherein the belt is a component into a more complex article such as a backpack.

The method of paragraph 57 wherein one or more loads is attached to the belt along the circumference of the such as a holster or a flashlight.

A belt accessory system for a user having pelvis, a right and a left gluteus muscle group, an abdominal muscle group, and a lower back muscle group, and a waist defined by the contours of said pelvis and muscle groups, wearing a belt around said waist, the belt accessory system comprising: a semi-rigid plate which approximates the contours of the body of the user on one of the lateral sides of the pelvis wherein the curvature of the plate in the horizontal plane is naturally slightly larger than the wearer's waist such that when compressed against the body under the force of a belt placed around the waist and over the plate, the plate exerts a outward spring force against the belt.

The belt accessory system of paragraph 60 wherein the system comprises two of said semi-rigid plates, placed against for each of the left and right lateral sides of the pelvis.

The belt accessory system of paragraph 60 wherein the semi-rigid plate is a component of a load carried by the belt such as a gun holster.

The belt accessory system of paragraph 60 wherein the semi-rigid plate is a component of a load carried by the belt such as a flashlight hook.

The belt accessory system of paragraph 60 wherein the semi-rigid plate is made of plastic.

The belt accessory system of paragraph 64 wherein said plastic is ABS.

The belt accessory system of paragraph 64 wherein said plastic is PVC.

The belt accessory system of paragraph 60 wherein the semi-rigid plate is made of a composite material such as carbon fiber.

The belt accessory system of paragraph 60 where in the semi-rigid plate is made of a flexible metal.

The belt accessory system of paragraph 60 wherein said semi-rigid plate contains a pair of holes that are separated by approximately the width of a belt.

The belt accessory system of paragraph 65 wherein said semi-rigid plate contains a series of two or more pairs of holes along the axis of the waistline.

The belt accessory system of paragraph 61 wherein said plates are attached to the belt.

The belt accessory system of paragraph 61 wherein said plates are attached to the pants.

The belt accessory system of paragraph 67 wherein said attachment effected by a fastener.

The belt accessory system of paragraph 67 wherein said attachment effected by pressure between the belt and the pants.

The belt accessory system of paragraph 61 wherein said plates are a component of the belt.

The belt accessory system of paragraph 61 wherein said plates are a component of the pants.

The belt accessory system of paragraph 61 wherein said plates are connected to one another by some means other than the belt.

The belt accessory system of paragraph 61 wherein said plates are sized to fit a duty belt.

The belt accessory system of paragraph 61 wherein said duty belt is a police belt.

The belt accessory system of paragraph 61 wherein said duty belt is a carpentry belt.

The present invention includes many embodiments including, but not limited to the embodiments described in the following paragraphs. It should be understood by those skilled in the art that it is not intended to limit the invention to the specific embodiments described. Various modifications, omissions, and additions may be made to the disclosed embodiments without materially departing from the novel teachings and advantages of the invention, particularly in light of the foregoing teachings.

What is claimed is:

1. A load bearing device comprising:

a first load bearing plate which conforms to a wearer's right hip, said first load bearing plate comprising a first semi-rigid plate that has a first uncompressed condition having a horizontal cross sectional curve that is greater than a right human pelvic region of the wearer and a first compressed condition having a horizontal cross-sectional curve that approximates the right human pelvic region of the wearer, the first load bearing plate having a resilience that biases the first load bearing plate towards the first uncompressed condition and away from the first compressed condition;

a second load bearing plate which conforms to the wearer's left hip, said second load bearing plate including a second semi-rigid plate that has a second uncompressed condition having a horizontal cross sectional curve that is greater than a left human pelvic region of the wearer and a second compressed condition having a horizontal cross-sectional curve that approximates the left human pelvic region of the wearer, the second load bearing plate being having a resilience that biases the first load bearing plate towards the second uncompressed condition and away from the second compressed condition; and a load bearing belt engaging the first and second load bearing plates, the load bearing belt arranged so that when the first load bearing plate is aligned with the right human pelvic region of the wearer, when the second load bearing plate is aligned with the left human pelvic region of the wearer, and when the load bearing belt is cinched around the human pelvic region, the first and second load bearing plates are moved, against the biasing resilience of the first and second load bearing plates, into the compressed conditions and into engagement with the human pelvic region so as to transfer vertically-oriented loads applied to the load bearing belt to the legs of the wearer via the hips of the wearer.

2. The device of claim 1 wherein:

each of said first load bearing plate and said second load bearing plate includes a vertical cross-section having a substantially vertical upper section adjoining a laterally flaring lower section so as to approximate a surface profile of the wearer's lateral hip region.

3. The device of claim 1 wherein:

each of said first load bearing plate and said second load bearing plate includes varying vertical cross-sections which more accurately approximate a surface profile of the wearer's lateral hip region.

4. The device of claim 1 wherein:

said first load bearing plate is worn opposite to the second load bearing plate on a human.

5. The device of claim 1 wherein:

said first load bearing plate has a major curvature in the first uncompressed condition that has a larger radius than a local radius of a hip and wherein said first load bearing plate can be flexed in the first compressed condition so as to conform to a hip of a human; and said second load bearing plate has a major curvature in the second uncompressed condition that has a larger radius than a local radius of a hip and wherein said second load bearing plate can be flexed in the second compressed condition so as to conform to a hip of a human.

6. The device of claim 1 wherein:

said first load bearing plate and said second load bearing plate being resilient comprises the plates being stiff, and being stiff prevents local discontinuities or curvature inversion when the plates are subject to one of point and line load.

7. The device of claim 1 wherein:

said first load bearing plate and said second load bearing plate being resilient comprises the plates being stiff and being stiff permits distribution of local loads over said first and second plates.

8. The device of claim 1 wherein:

the first and second load bearing plates include slots that are adapted for use with belt keepers, and first and second load bearing plates are attached to the load bearing belt via belt keepers engaging the slots and the load bearing belt.

9. The device of claim 1 wherein said load bearing belt comprises a full-loop load bearing belt.

10. The device of claim 1 wherein the first and second load bearing plates are attached to the load bearing belt via loops fixed to the interior of the load-bearing plates.

11. The device of claim 2 wherein each of said first load bearing plate and said second load bearing plate comprises one or more apertures located proximate to a position at which the substantially vertical upper section adjoins the laterally flaring lower section.

12. The device of claim 11 wherein the first and second load bearing plates attach to the load-bearing belt by at least one of said one or more apertures.

13. The device of claim 11 wherein the first and second load bearing plates are attached to the load bearing belt via belt keepers engaging the said at least one of said one or more apertures.

14. A load bearing device comprising:

a first load bearing plate which conforms to a wearer's right hip, said first load bearing plate comprising a first semi-rigid plate that has a first uncompressed condition having a horizontal cross sectional curve that is greater than a right human pelvic region of the wearer and a first compressed condition having a horizontal cross-sectional curve that approximates the right human pelvic region of the wearer, the first load bearing plate having a resilience towards the first uncompressed condition and away from the first compressed condition;

a second load bearing plate which conforms to a wearer's left hip, said second load bearing plate including a second semi-rigid plate that has a second uncompressed condition having a horizontal cross sectional curve that is greater than a left human pelvic region of the wearer and a second compressed condition having a horizontal cross-sectional curve that approximates the horizontal cross-section of the left human pelvic region of the wearer, the second load bearing plate having a resilience towards the second uncompressed condition and away from the second compressed condition;

each of said first load bearing plate and said second load bearing plate including a vertical cross-section having a substantially vertical upper section adjoining a laterally flaring lower section so as to approximate a surface profile of the wearer's lateral hip region;

a load bearing belt engaging the first and second load bearing plates;

the load bearing belt being arranged so that when the first load bearing plate is aligned with the right human pelvic region of the wearer, when the second load bearing plate is aligned with the left human pelvic region of the wearer, and when the load bearing belt is cinched around the human pelvic region, the first and second load bearing plates are moved, against the biasing resilience of the first and second load bearing plates, into the compressed conditions and into engagement with the human pelvic region so as to transfer vertically-oriented loads applied to the load bearing belt to the legs of the wearer via the hips of the wearer;

said first load bearing plate and said second load bearing plate being resilient comprises the plates being stiff, and being stiff prevents local inversion when the plates are subject to one of point and line load; and said first load bearing plate and said second load bearing plate including at least one of elements adapted to enable attachment to the load bearing belt and elements adapted to enable incorporation of said first and second plates into the load bearing belt, clothes, backpacks and other load bearing devices.

15. The device of claim 14 wherein said first load bearing plate and said second load bearing plate being resilient comprises the plates being stiff, and being stiff permits distribution of local loads over said first and second plates.

16. The device of claim 14 wherein said load bearing belt comprises a full-loop load bearing belt.

17. The device of claim 14 wherein:

the first and second load bearing plates are attached to the load bearing belt via loops fixed to the interior of the load-bearing plates.

* * * * *